US005212366A

United States Patent [19]

McDougall

[11] Patent Number: 5,212,366

[45] Date of Patent: May 18, 1993

[54] HANDHELD HAIR CARE APPLIANCE WITH ADJUSTABLE DIAMETER BARREL PROVIDING HEATED AIRFLOW

[75] Inventor: Gregory J. McDougall, Kowloon, Hong Kong

[73] Assignee: China Pacific Trade Ltd., British Virgin Isls.

[21] Appl. No.: 818,246

[22] Filed: Jan. 8, 1992

Related U.S. Application Data

[63] Continuation-in-part of Ser. No. 711,092, Jun. 6, 1991, abandoned.

[30] Foreign Application Priority Data

Oct. 24, 1990 [GB] United Kingdom ..... 9023157
Feb. 7, 1991 [GB] United Kingdom ..... 9102630

[51] Int. Cl.[5] ..... A45D 1/04; A45D 20/12; F24H 3/04

[52] U.S. Cl. ..... 219/222; 34/97; 34/243 R; 132/212; 132/229; 132/271; 219/230; 392/383

[58] Field of Search ..... 219/222-226, 219/230; 392/379-381, 383-385; 34/96-101, 243 R; 132/212, 271, 272, 229, 237

[56] References Cited

U.S. PATENT DOCUMENTS 4,023,578 5/1977 Buhler ..... 132/269

FOREIGN PATENT DOCUMENTS 2825099 12/1979 Fed. Rep. of Germany ..... 132/212

*Primary Examiner*—Anthony Bartis
*Attorney, Agent, or Firm*—Burns, Doane, Swecker & Mathis

[57] ABSTRACT

An electrically powered hand held hair curling appliance includes a barrel (2) for delivering warm air to the hair. The barrel (2) is selectively manually adjustable in diameter to allow curls of different diameters to be formed. The barrel (2) includes a number of barrel elements (3), each provided with a plurality of apertures (3*d*). The elements (3) are manually movable radially outwardly or inwardly to expand or contract the barrel (2), with the elements (3) overlapping one another when contracted, but always allowing unobstructed air flow from the interior of the barrel (3) out through apertures (3*d*) to the hair.

2 Claims, 7 Drawing Sheets

Fig. 6
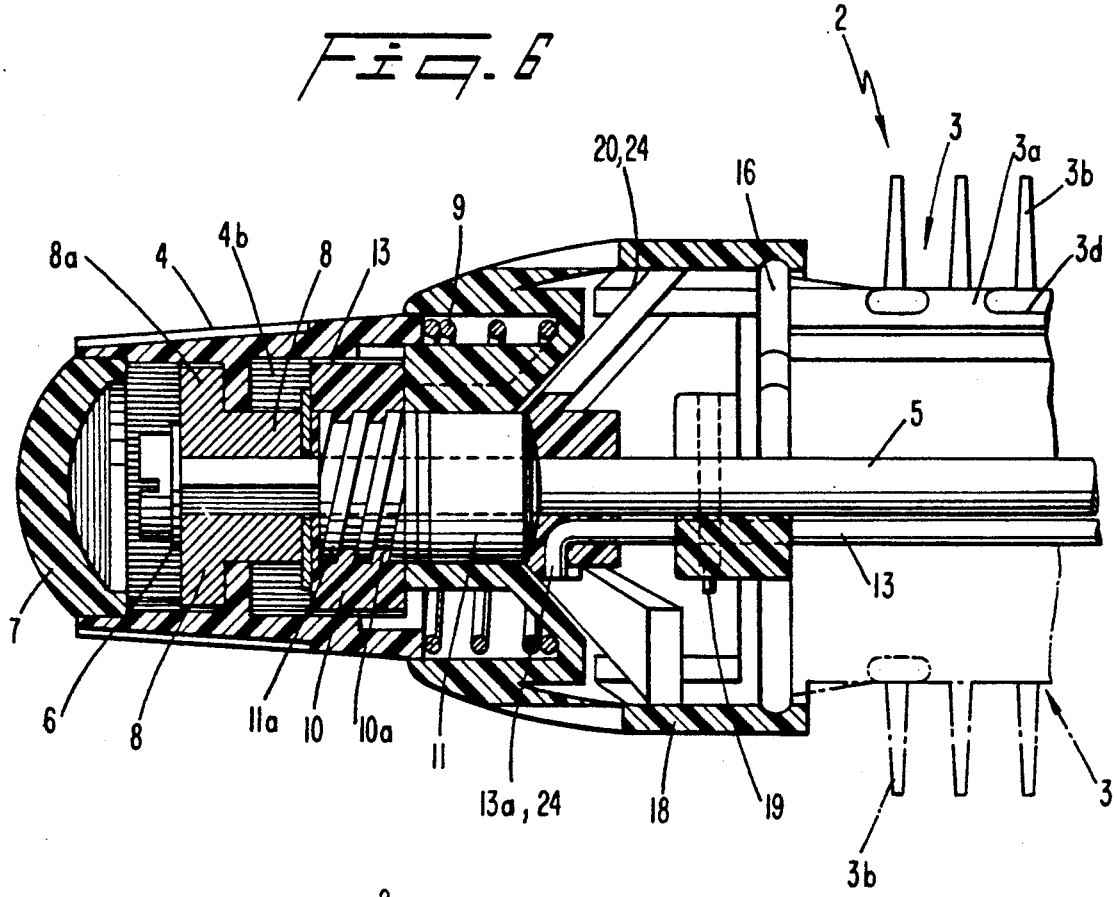
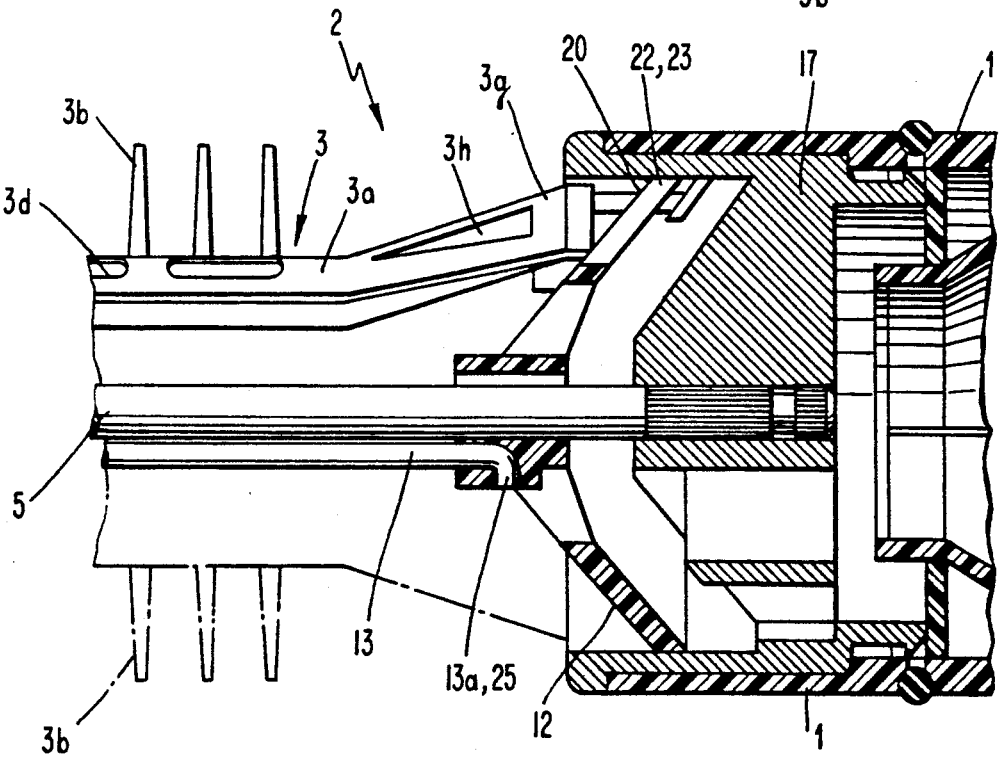
Fig. 7

HANDHELD HAIR CARE APPLIANCE WITH ADJUSTABLE DIAMETER BARREL PROVIDING HEATED AIRFLOW

This is a continuation-in-part of Application Ser. No. 07/711,092, filed Jun. 6, 1991, now abandoned.

The present invention relates to electrically powered hand held hair curling appliances of the type comprising a handle by means of which the appliance is held; a barrel extending from the handle on which the hair to be curled is wound externally, the barrel being hollow to allow fluid flow along the barrel, the barrel being provided with apertures to allow the fluid to flow outwardly to the hair, and the barrel being of adjustable diameter between a fully expanded and a fully contracted state to allow curls of different diameter to be formed.

DE-A-25 28 822 in the name Hubner and DE-A-25 29 026 in the same name (the latter being an application for a patent of addition to the former) both describe hair curling appliances. Hubner describes a hair curling appliance which uses steam as a fluid. The barrel consists of a hollow perforated cylinder which is of fixed diameter, on the outside of which are pivotally mounted a number of perforated semicircular segments. The segments may be pivotally moved together outwardly to increase the diameter of the barrel or inwardly to decrease the diameter of the barrel.

The Hubner hair curler suffers from a number of disadvantages. Firstly, the Hubner barrel has a large diameter even when fully contracted. This large diameter arises from the construction, in particular because the barrel comprises segments fixed externally to a cylinder. The minimum diameter is stated to be 20 mm, which is at the upper end of the range of desirable curl diameters. Secondly, the Hubner appliance is intended to apply a low volume, low pressure supply of steam to the hair. It would be unsuitable for use in applying a substantial flow of dry warm air to the hair for the purpose of drying and styling, in particular because in the Hubner appliance the fluid must flow along a circuitous path from the interior of the cylinder out through one set of apertures into the area between the cylinder and the segments, and then out through another set of apertures to the hair. The two sets of apertures are generally not aligned with another. Finally, the appliance proposed by Hubner would suffer from condensation problems with drops of water falling from the appliance onto the hair.

U.S. Pat. No. 3,921,648 to Barradas also describes a hair curling appliance of the type described. The appliance is a steam curling iron. The barrel consists of a central hollow perforated cylinder of fixed diameter on the outside of which is mounted a perforated expansible mandrel of resilient stainless steel.

The Barradas hair curling appliance suffers from the same disadvantages as the Hubner appliance, namely a large diameter when fully contracted arising from the two-layer structure, unsuitability for high volume flow of warm dry air arising from a circuitous path through two sets of apertures which are not in register, and condensation leading to drops of water falling on the hair.

An object of the present invention is to provide an improved curling appliance of the type described which in the fully contracted state has a substantially smaller diameter than the prior art devices. Another object of the present invention is to provide an improved hair curling appliance of the type described which can deliver a substantial flow of warm dry air to the hair.

The invention provides a hair curling appliance of the type described in which the barrel comprises a number of elongate barrel elements arranged in mutually parallel radial relationship to form a generally axially symmetric barrel, the barrel elements being movable radially inwardly together and radially outwardly together so as to contract and expand the diameter of the barrel, the barrel elements mutually combining to form a substantially closed barrel when in the fully expanded state and a substantially closed barrel with overlapping barrel elements in the contracted state, and the barrel elements being provided with apertures which allow fluid to flow from the interior of the barrel directly out to the hair when the barrel is in the fully expanded, fully contracted or any intermediate state.

The hair curling appliance according to the present invention has a number of advantages. Firstly, the structure allows a barrel of small diameter to be constructed. Secondly, air flow directly form the interior of the barrel to the hair, allowing a large volume of air to be applied to the hair.

BRIEF DESCRIPTION OF THE DRAWINGS

FIGS. 6 and 7 are views similar to FIG. 2, but on a larger scale, showing the adjustment mechanism for the barrel, FIG. 6 showing the outer end of the barrel and FIG. 7 showing the inner end;

DETAILED DESCRIPTION OF THE PREFERRED EMBODIMENTS

Referring now to FIGS. 1 to 7 of the drawings, the warm air brush comprises a gripping handle 1, a barrel 2 which is used to brush the hair, and a heater blower (shown in phantom) located in the gripping handle 1 for heating a which is then directed along the barrel 1 and emerges through apertures described below to warm the hair being brushed.

Figure 5B:
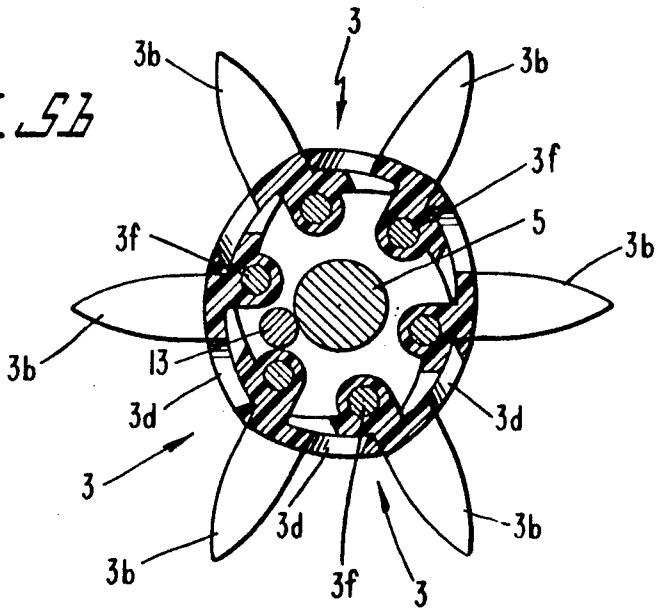
FIGS. 5*a* and 5*b* are sectional views on A—A of FIG. 2 and show the barrel in the expanded and contracted state thereof respectively.
Figure 5A:
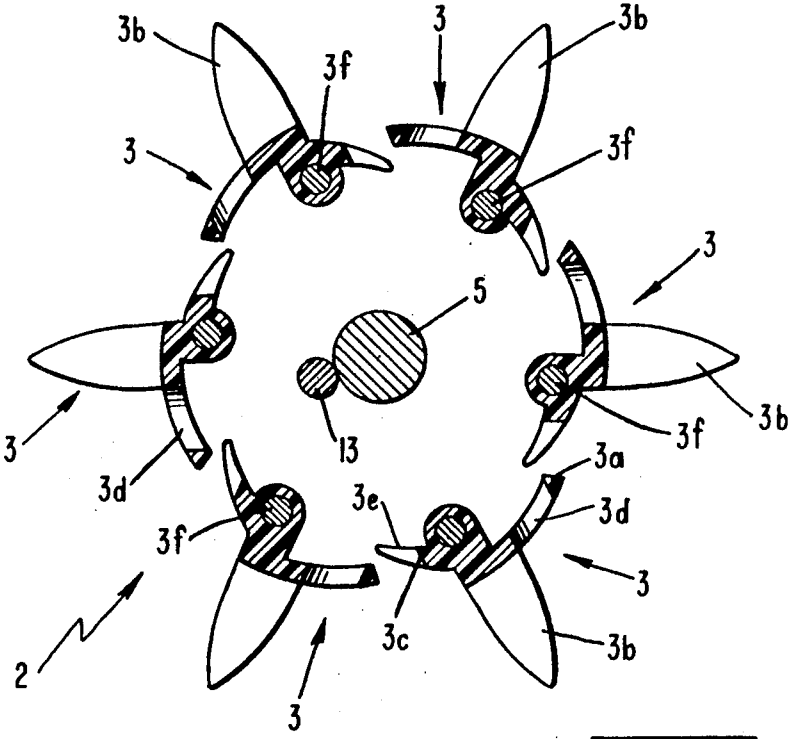

The barrel 2 consists of six elongate barrel elements 3 arranged in mutually parallel radial relationship to form a generally cylindrical barrel. Each barrel element 3 consists of a base 3*a*, a row of projecting brush teeth 3*b*, a lateral projection 3*c* at one side of the base for underlying the base 3*a* of the adjacent element, a row of apertures 3*d* in the base 3*a* and a row of indentations 3*e* in the lateral projection 3*c*. Each barrel element 3 is integrally formed of plastic material but includes a metal stiffening rod 3*f*. FIG. 5*b* shows the barrel 2 in the fully contracted state with the bases 3*a* abutting one another FIG. 5*a* shows the barrel 2 in the fully expanded state with gaps between the bases 3*a*, these gaps being closed by the lateral projections 3*c*. Closure of the gaps ensures that the barrel 2 is substantially closed so that the warm air flowing down the barrel escapes only through the apertures 3*d*. The external diameter of the barrel 2 is 14 mm in the fully contracted state and 21 mm in the fully expanded state.

Figure 4A:
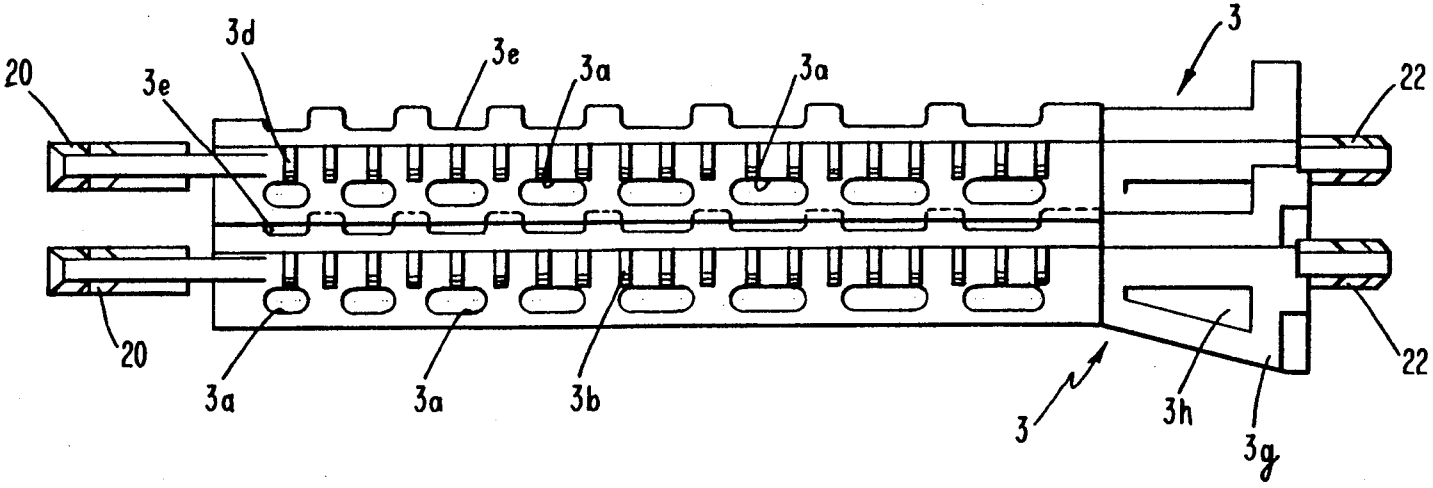
FIGS. 4*a* and 4*b* show two adjacent barrel elements with the barrel in the fully expanded and the fully contracted state respectively.
Figure 4B:
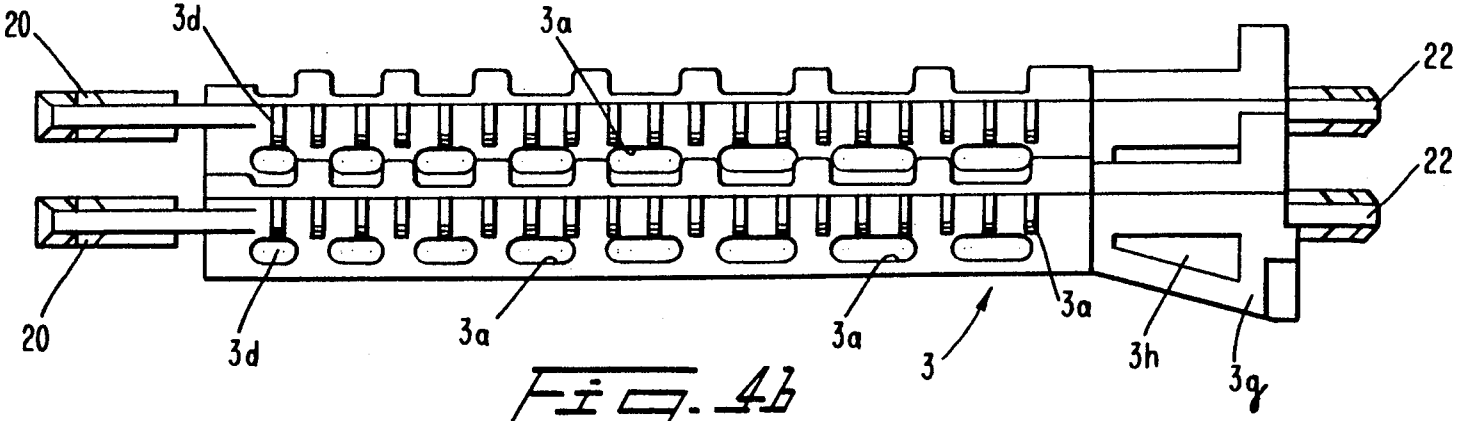

As best seen in FIGS. 4*a* and 4*b*, the apertures 3*d* are always unobstructed, allowing a substantial volume of warm dry air to be delivered directly from the interior of the barrel 2 to the hair, without any risk of back pressure or overheating of the heater blower. When the barrel 2 is in the fully expanded state as shown in FIG. 4*a*, air emerges through the apertures 3*d* and also through the indentations 3*e*. When the barrel 2 is in the fully contracted state as shown in FIG. 4*b*, the indentations 3*e* move into register with the apertures 3*d*, so that the apertures remain unobstructed.

The user expands or contracts the barrel 2 by means of the adjustment knob 4 located at the tip of the barrel. The user grips the knob 4, depressing the knob axially along the barrel 2 towards the handle 1 against spring biasing so as to disengage the knob 4 from a locking mechanism. The user then rotates the knob 4 clockwise to expand the barrel 2 or anti-clockwise to contract the barrel 2, and then releases the knob 4 so that the latter moves axially back along the barrel 2 under the influence of the spring biassing and re-engages the locking mechanism to prevent further rotation.

Figure 1:
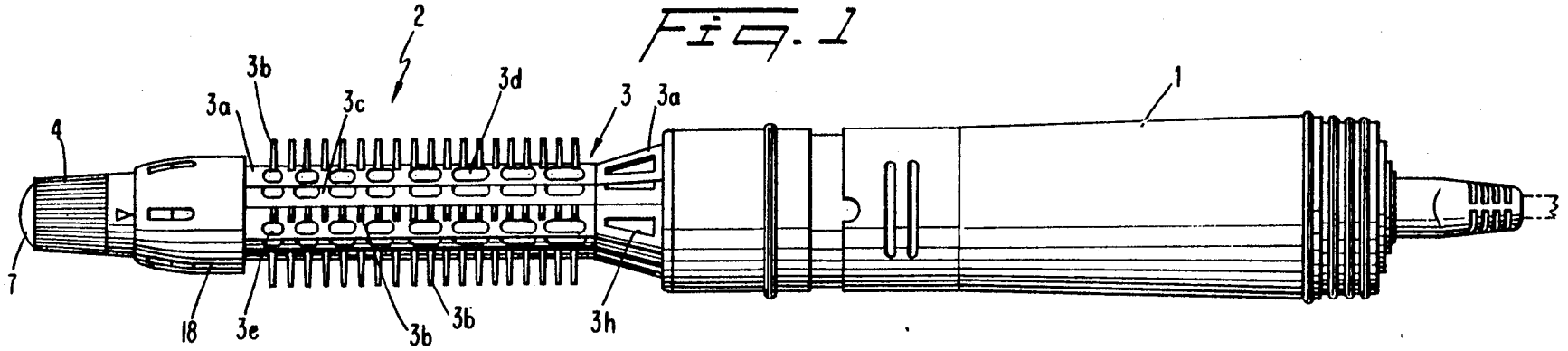
FIG. 1 is a side elevation of a warm air brush including a barrel of adjustable diameter in accordance with the invention shown in the expanded state.
Figure 2:
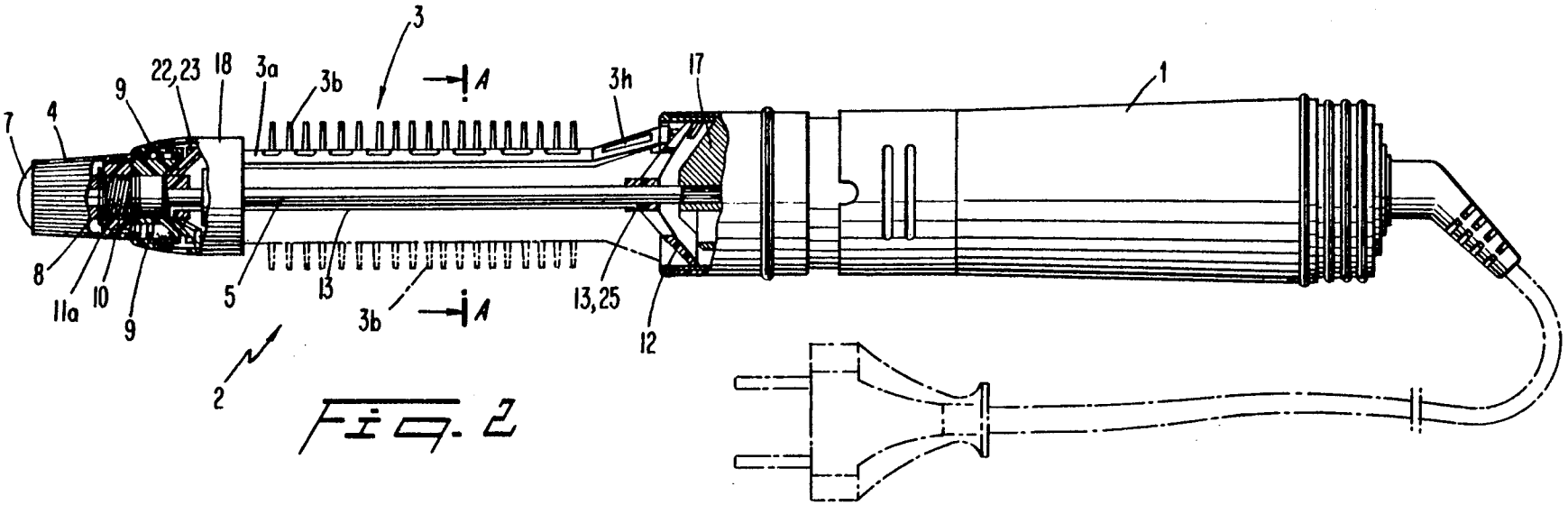
FIG. 2 is a view similar to FIG. 1, but showing the barrel in cross section.
Figure 3:
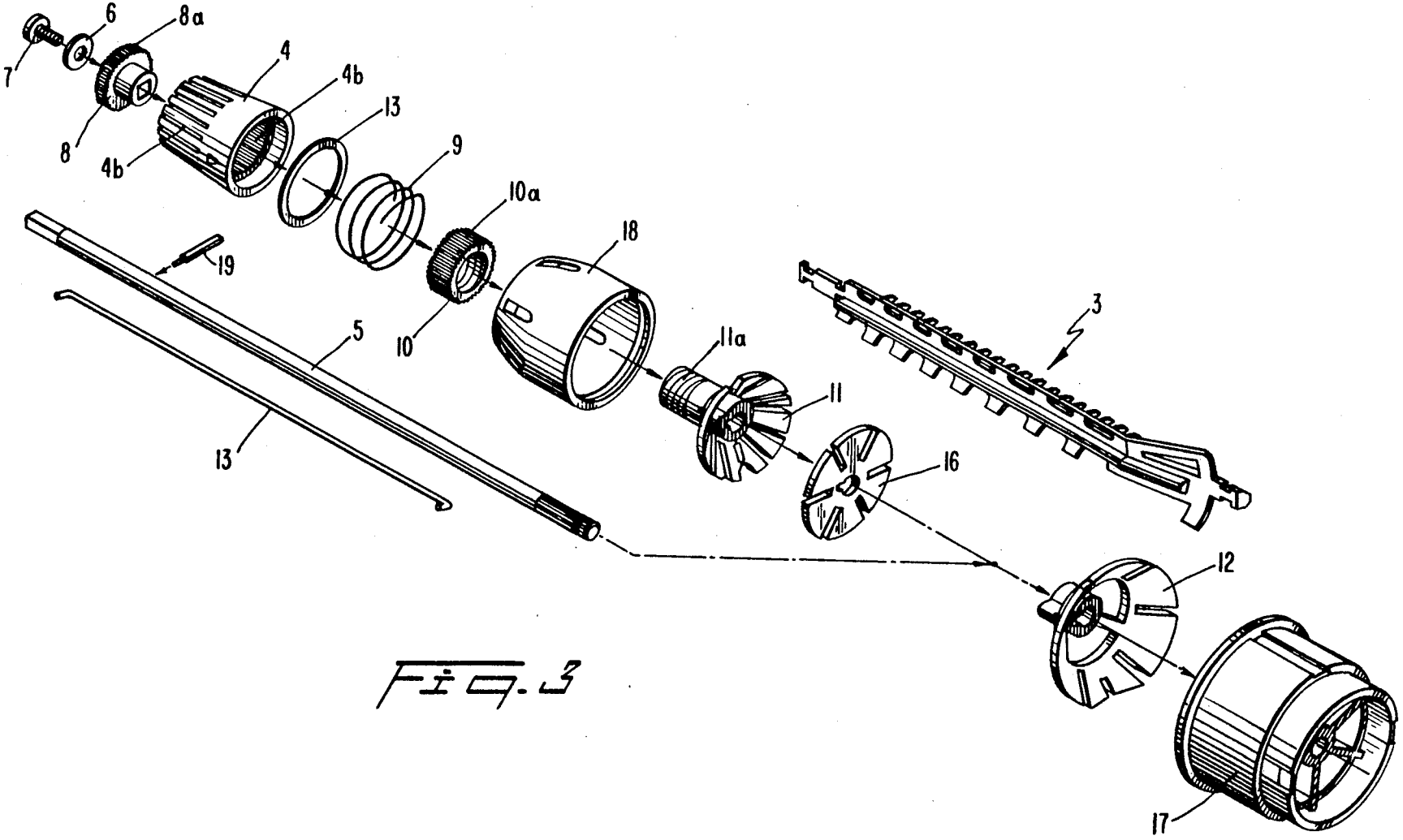
FIG. 3 is an exploded perspective view of the barrel on a larger scale, showing the principal components.

The locking mechanism will now be described. A fixed central shaft 5 extends from the handle 1. A washer 6 and cap 7 are provided at the outer end of the fixed central shaft 5. A flanged collar 8 is fixedly mounted at the end of the shaft 5 just inwardly of the cap 7 and washer 6, and has gear-teeth 8*a* on the outer circumferential surface of the flange as shown in FIG. 3. The adjustment knob 4 has splines 4*a* on the inner circumferential surface which normal position thereof as shown in FIG. 6 engages with the teeth 8*a* on the flanged collar 8, thereby preventing rotation of the adjustment knob 4. The adjustment knob 4 is held in the normal position by a coiled compression spring 9 which biases the adjustment knob 4 towards the outer end of the shaft 5 into abutment with the washer 6.

The adjustment mechanism will now be described. When the adjustment knob 4 is depressed against the action of the coiled spring 9, the inwardly projecting splines 4*a* of the adjustment knob 4 move out of meshing engagement with the externally projecting teeth 8*a* on the flanged collar 8, allowing the adjustment knob 4 to be rotated. The subsequent rotation of the adjustment knob 4 causes corresponding rotation of nut 10, the adjustment knob and nut 10 being held together by meshing splines 4*b* and 10*a*. The nut 10 is threaded on external screw threading 11*a* on the shank of front cam 11 which is slidably mounted on the central shaft 5. Double helix threading is used for extra stability. The nut 10 is held in a fixed axial position between the front cam housing 18 and the flanged collar 8. As a result, rotation of the adjustable knob 4 and consequent rotation of the nut 10 causes lengthwise axial movement of the front cam 11. The axial movement of the front cam 11 is transmitted by connecting rods 13 to the rear cam 12 which is also slidably mounted on the central shaft 5. As the front and rear cams 11, 12 move axially, axial movement of the barrel elements 3 is prevented by stopping member 16 which is fixed on the central shaft 5 by means of locking pin 19 (best seen in FIG. 6), and the barrel elements 3 are caused to ride up or down the cams 11, 12 so that the barrel 2 expands or contracts radially The cams 11, 12 are located in the front cam housing 18 and rear cam housing 17 respectively. Front cam housing 18 is fixed on the stopping member 16 and rear cam housing 17 is fixed to the central shaft 5 and allows air to flow therethrough to the interior of the barrel 2.

By way of further explanation the co-operation of the barrel elements 3, cams 11, 12 and connecting rods 13 will now be described. The outer end of each barrel element 3 is provided with a pair of angled side slots which define an angled neck 20 for engaging the inclined radial slots 21 in the front cam 11. The outer end of each barrel element 3 is provided with a pair of angled side slots defining angled neck 26 for engagement in radial slots 16*a*in the stopping member 16. The inner end of the barrel element 3 has an inclined portion 3*g* so that in combination the six barrel elements have a flared inner end, the largest diameter of which substantially matches the diameter of the handle 1 to allow a large flow of air to be introduced into the barrel. One large triangular aperture 3*h* is provided in each inclined portion which serves the dual purpose of delivering air to the outside surface of the curled hair and venting any air pressure buildup to prevent overheating of the heater blower. In addition each inclined portion 3*g* finishes with an inclined neck 22 which engages in an inclined radial slot 23 in the rear cam 12. The connecting rods 13 are disposed, as best seen in FIG. 7, alongside the central shaft 5 and are provided at each end with an outwardly turned right angle bend 13*a* which engage in holes 24, 25 in the front and rear cams 11, 12 respectively.

Figure 8:
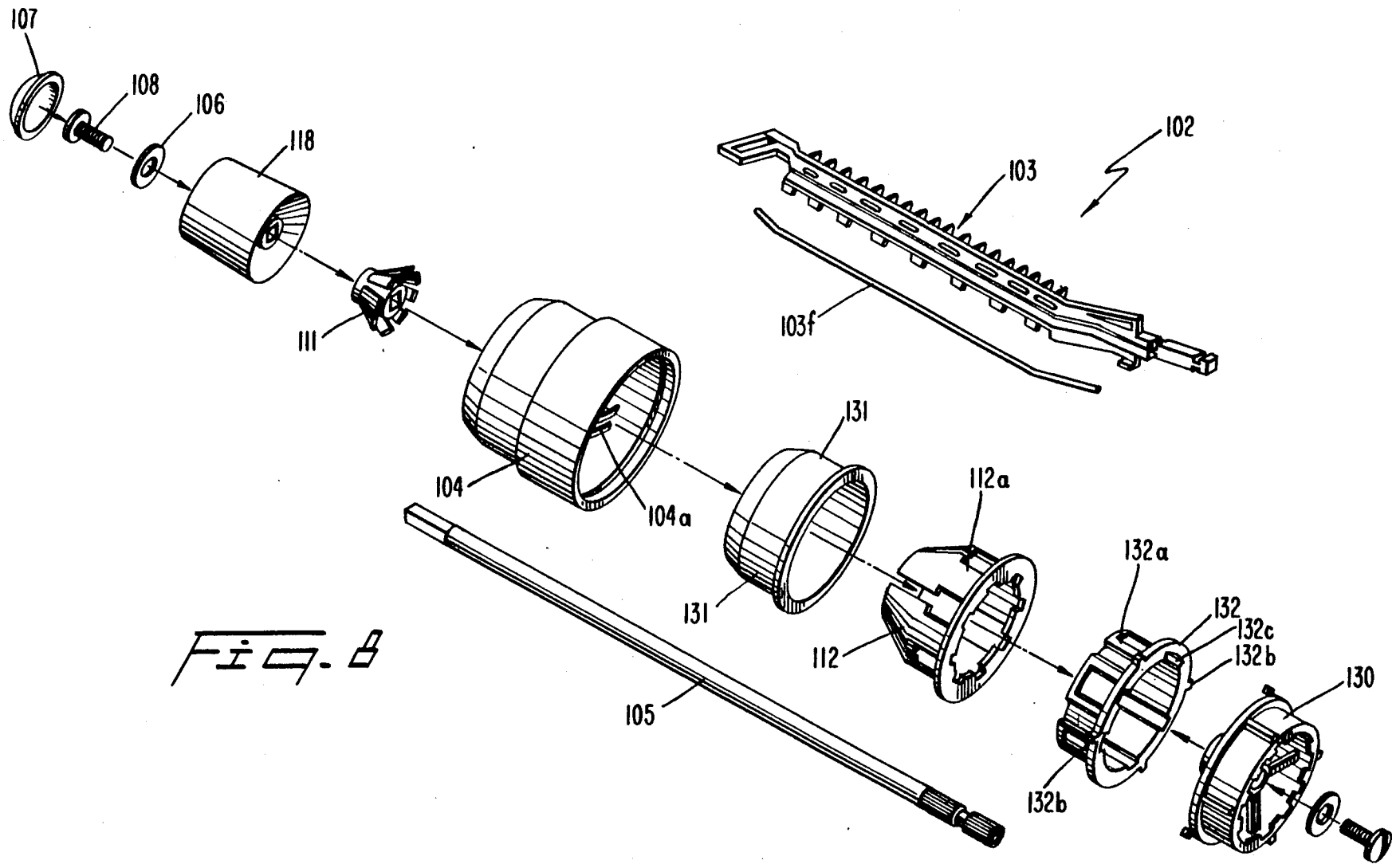
FIG. 8 is a view similar to FIG. 3, but showing a modified construction of warm air brush.
Figure 9:
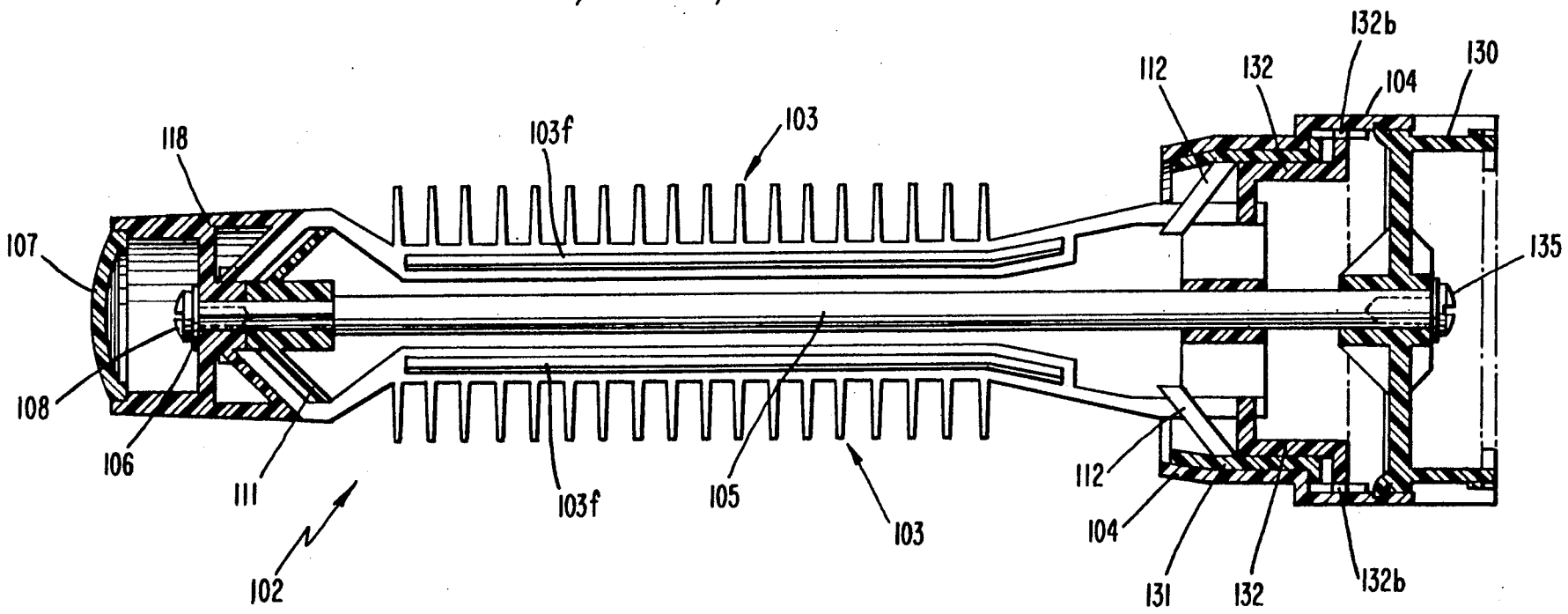
FIG. 9 is a sectional side elevation of the barrel and adjustment mechanism of the modified construction.

FIGS. 8 and 9 show a modification in which the diameter of the barrel 102 is adjustable by means of a thumb-operated knob 104 at the inner end of the barrel. This arrangement allows the appliance to be held in one hand and the barrel diameter to be adjusted by the thumb of that hand. There is no locking mechanism to prevent rotation of the knob 104. The components comprise a shaft mounting bracket 130 fixed to the handle (not shown), a fixed central shaft, a screw 135 for securing the bracket 150, 130 to the shaft 105, a front cam 111 fixed to the shaft 105, a rear cam 112 fixed to the shaft 105, a front cam housing 118, a washer 106, a cap 107 and bolt 108 barrel element 103, including barrel element base 103*a*, teeth 103*b*, lateral projection 103*c*, apertures 103*d*, indentations 103*e* and a barrel element stiffening rod 103*f*, and a heat shield 131 which fits inside the knob 104. An essential component of the mechanism is puller element 132. This component is prevented from rotating by the engagement of feet 132*a* in apertures 112*a* in the rear cam 112, but is free to move axially along the shaft 105. The puller element 132 is provided with three equally spaced external lugs 132*b* which co-operate with helical grooves 104*a* on the inside face of the rotatable knob 104.

When knob 104 is rotated, the co-operation of lugs 132*b* and grooves 104*a* causes the puller element 132 to move axially along the shaft 105. This axial movement is in turn transmitted to the barrel elements 103 by virtue of the engagement of the neck 103*a* of each barrel element 103 in a corresponding slot 132*c* in the puller element 132 As the barrel elements 103 move axially they ride up or down the front and rear cams 111, 112 causing the barrel 102 to expand or contract.

The invention is not limited to warm air brushes. The invention may be applied to a variety of different hair care appliances, for example hair curling irons.

What is claimed is:

1. An electrically powered hand held hair care appliance comprising:

a handle by means of which the appliance is held;

a barrel extending from the handle on which the hair to be curled is wound externally, the barrel being hollow to allow fluid flow along the barrel, the barrel being provided with apertures to allow the fluid to flow outwardly to the hair, and the barrel being of adjustable diameter between a fully expanded and a fully contracted state to allow curls of different diameter to be formed, wherein the barrel comprises:

a number of elongate barrel elements supported by means associated with the handle and arranged in mutually parallel radial relationship to form a generally axially symmetric barrel, the barrel elements being movable radially inwardly together and radially outwardly together so as to contract and expand the diameter of the barrel, the barrel elements mutually combining to form a substantially closed barrel when in the fully expanded state and a substantially closed barrel with overlapping barrel elements which allow fluid to flow from the interior of the barrel directly out to the hair when the barrel is in the fully expanded, fully contracted or any intermediate state; and means associated with the barrel elements for selectively moving the barrel elements radially inwardly and outwardly between the fully expanded state and the fully contracted state.

2. A hair cutting appliance according to claim 1 in which each barrel element comprises an elongate base, a row of brush teeth projecting radially outwardly from the base, a row of apertures in the base, and a lateral projection extending along one side of the elongate base for underlying the base of the adjacent barrel element in the contracted or partially contracted state without blocking said apertures therein.

* * * * *